US006883697B1

(12) United States Patent
Chi Kuo

(10) Patent No.: US 6,883,697 B1
(45) Date of Patent: Apr. 26, 2005

(54) OFFICE TOOL ASSEMBLY

(75) Inventor: Su-Chao Chi Kuo, Tali (TW)

(73) Assignee: Apex Mfg. Co., Ltd., Tali (TW)

( * ) Notice: Subject to any disclaimer, the term of this patent is extended or adjusted under 35 U.S.C. 154(b) by 67 days.

(21) Appl. No.: 10/785,202

(22) Filed: Feb. 23, 2004

(51) Int. Cl.[7] ..... B43L 23/08

(52) U.S. Cl. ..... 227/76; 227/134; 227/156; 30/452; 30/464; 30/457; 7/160

(58) Field of Search ..... 227/134, 76, 156; 30/452, 453, 454, 451, 457, 458, 459, 298.4

(56) References Cited

U.S. PATENT DOCUMENTS 4,014,493 A * 3/1977 Wolfe ..... 227/156
4,278,017 A 7/1981 Conjura
4,727,610 A * 3/1988 Lin ..... 7/160
5,367,777 A * 11/1994 Nguyen et al. ..... 30/459
5,690,268 A 11/1997 Evans et al.
5,797,535 A * 8/1998 Lovegrove et al. ..... 227/120
5,987,759 A * 11/1999 Nita ..... 30/454
6,152,347 A 11/2000 Wilson et al.
6,249,981 B1 * 6/2001 Shu ..... 30/457
6,338,198 B1 * 1/2002 Rolls ..... 30/452
6,338,430 B1 * 1/2002 Cheng ..... 227/134
6,553,882 B1 * 4/2003 Daley et al. ..... 83/453
6,601,747 B1 * 8/2003 Chi Kuo ..... 227/76

* cited by examiner

*Primary Examiner*—Scott A. Smith
(74) *Attorney, Agent, or Firm*—Dellett & Walters

(57) ABSTRACT

An office tool assembly has a tool and a hanging cap. The tool is selectively inserted into and held in the hanging cap. A protrusion is moveably mounted on the tool to engage with a through hole defined in the cap to keep the tool from falling out of the hanging cap. A transverse hole is defined in the hanging cap through which a string extends, such that the tool assembly can be hung around a person's neck. Accordingly, a user can conveniently and safely carry the tool assembly to any desired place for use.

5 Claims, 3 Drawing Sheets

OFFICE TOOL ASSEMBLY

BACKGROUND OF THE INVENTION

1. Field of the Invention

The present invention relates to an office tool assembly, and more particularly to an office tool assembly that can be hung around a person's neck or a belt and is versatile in use.

2. Description of Related Art

Office tools, such as hole punches or staplers, are used to attach documents. A stapler holds multiple documents together with staples, and a hole punch make holes in documents so a string or clip can extend through the holes to hold the documents together. However, conventional office tools are not convenient for a person to carry or to use outside of the office, especially a salesman or a serviceman at an off-site location. Furthermore, staples in a stapler can easily injure a person. To use and carry a conventional office tool is inconvenient and unsafe.

Therefore, U.S. Pat. No. 6,601,747, entitled as "Office Tool Assembly" is provided to solve the aforementioned problems of the office tools. The office tool assembly of the '747 patent comprises a hanging cap and a tool. The hanging cap has a top, an open end, a closed end, a through hole defined in the top and a transverse hole defined through the closed end. The tool is inserted into the open end of the hanging cap and is held in the hanging cap. The tool comprises an upper cover, a bottom cover and a main mechanism. The upper cover has a top and a protrusion formed on the top of the upper cover and engaging the through hole in the hanging cap. The bottom cover is pivotally connected to the upper cover. The main mechanism is mounted between the upper cover and the bottom cover. With such an arrangement, a string can be extended through the transverse hole in the hanging cap, such that a person can hang the hanging cap with the tool around the neck with the string to conveniently and easily carry the tool to any desired place.

However, because the protrusion is integrally formed on the upper cover of the tool, the structure of tool assembly can be only applied to a tool with two covers pivotally combined with each other, such as a stapler or a hole puncher. The tool assembly of the '747 patent cannot be applied to a tool with two covers securely combined with each other, such as a pencil sharpener, thus, the use of the '747 patent is not versatile.

To overcome the shortcomings, the present invention tends to provide an office tool assembly to mitigate or obviate the aforementioned problems.

SUMMARY OF THE INVENTION

The main objective of the invention is to provide an office tool assembly that can be hung around a person's neck to conveniently and safely carry the tool assembly and is versatile in use. The office tool assembly in accordance with the present invention has a hanging cap and a tool. The tool is held in the hanging cap. A protrusion is moveably mounted on the tool to engage a through hole defined in the hanging cap to keep the tool from falling out of the hanging cap. A transverse hole is defined through the hanging cap, and a string, cord, chain or the like passes through the transverse hole so the tool assembly can hang around a person's neck or any desired object, such as a belt. Carrying the office tool assembly is convenient and safe, and the use of the tool assembly is versatile.

Other objects, advantages and novel features of the invention will become more apparent from the following detailed description when taken in conjunction with the accompanying drawings.

BRIEF DESCRIPTION OF THF DRAWINGS

DETAILED DESCRIPTION OF PREFERRED EMBODIMENT

Figure 1:
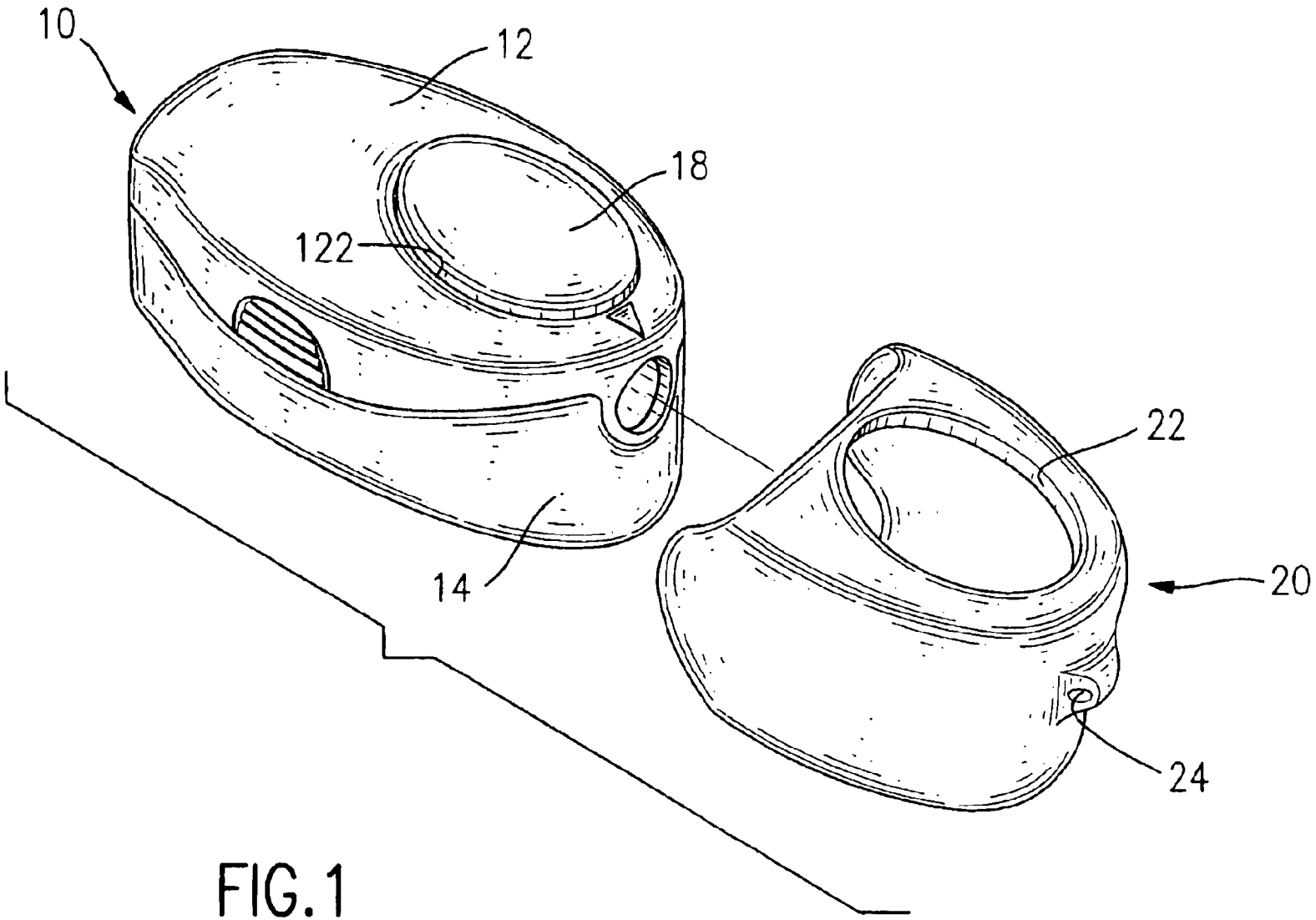
FIG. 1 is a perspective view of an office tool assembly in a separated status, in accordance with the present invention.
Figure 2:
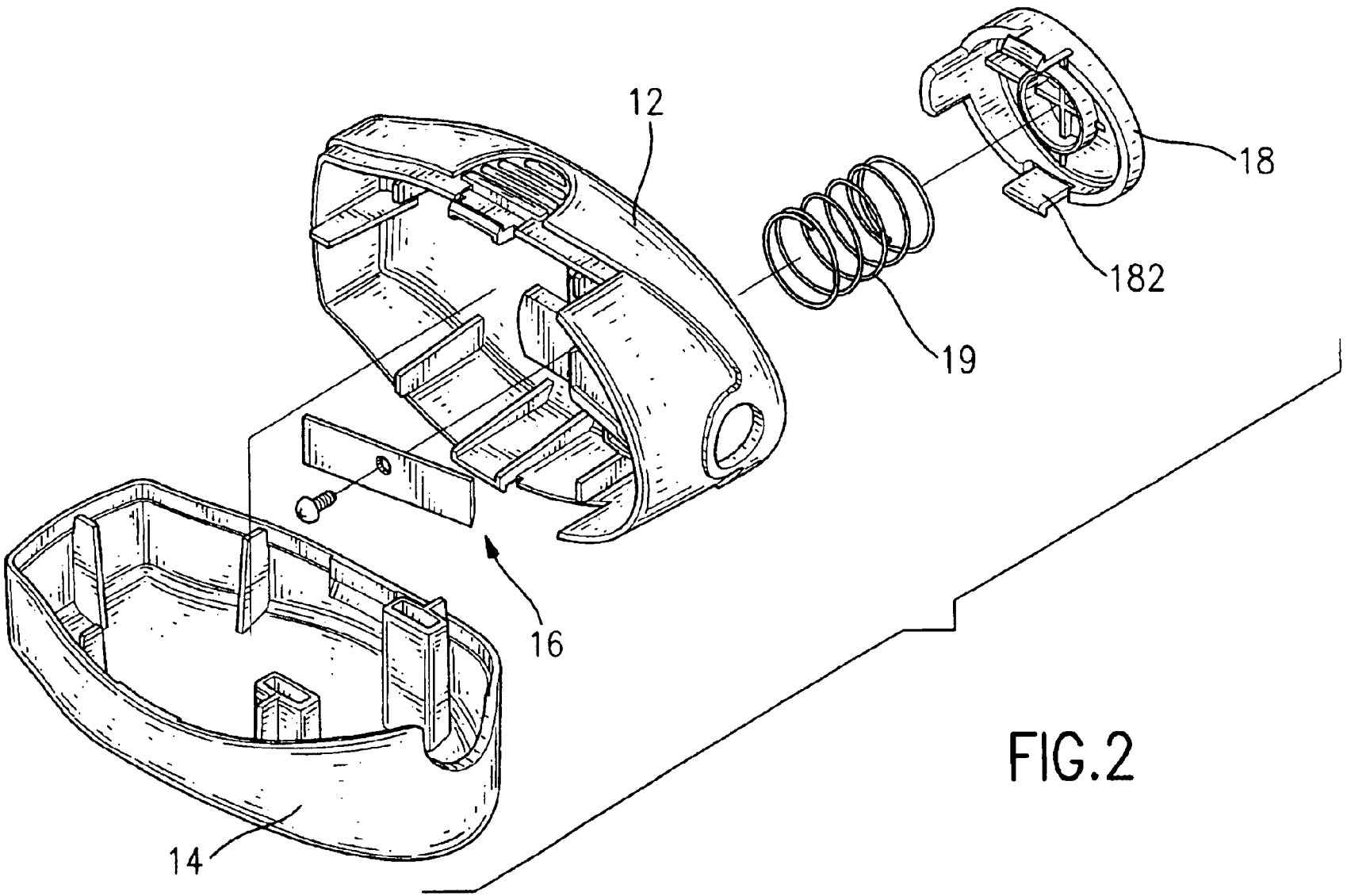
FIG. 2 is an exploded perspective view of the tool of the tool assembly in FIG. 1.

With reference to FIGS. 1 and 2, an office tool assembly in accordance with the present invention comprises a tool (10) and a hanging cap (20). The tool (10) is held in the hanging cap (20). The tool (10) has an upper cover (12) with a top (not numbered), a bottom cover (14) and a main mechanism (16). The main mechanism (16) is mounted between the upper cover (12) and the bottom cover (14), and the bottom cover (14) is securely connected to the upper cover (12). In an optional embodiment, the main mechanism (16) is a cutting mechanism to make the tool (10) a pencil sharpener. The upper cover (12) has a protrusion (18) moveably mounted on the top of the upper cover (12). In an optional embodiment, a recess (122) is defined in the top of the upper cover (12) and has a bottom (not numbered). The protrusion (18) is moveably received in the recess (122) and has a bottom (not numbered). A biasing member (19) is received in the recess (122) and has two ends (not numbered) abutting respectively against the bottoms of the recess (122) and the protrusion (18) to make the protrusion (18) exposed from the recess (122). The protrusion (18) may have two hooks (182) extending from the bottom of the protrusion (18) and extending through two holes (not shown) defined in the bottom of the recess (122). With the engagements of the hooks (182) on the protrusion (18) and the holes in the upper cover (12), the protrusion (18) will not escape from the recess (122) in the upper cover (12).

The hanging cap (20) has a top, an open end (not numbered), a closed end (not numbered), a through hole (22) and a transverse hole (24). The tool (10) is inserted into the hanging cap (20) through the open end. The closed end is opposite to the open end. The through hole (22) is defined in the top of the hanging cap (20) to engage the protrusion (18) on the upper cover (12) of the tool (10). When the protrusion (18) is in the through hole (22), the tool (10) will not fall out of the hanging cap (20). The transverse hole (24) is defined through the closed end of the hanging cap (20).

Figure 3:
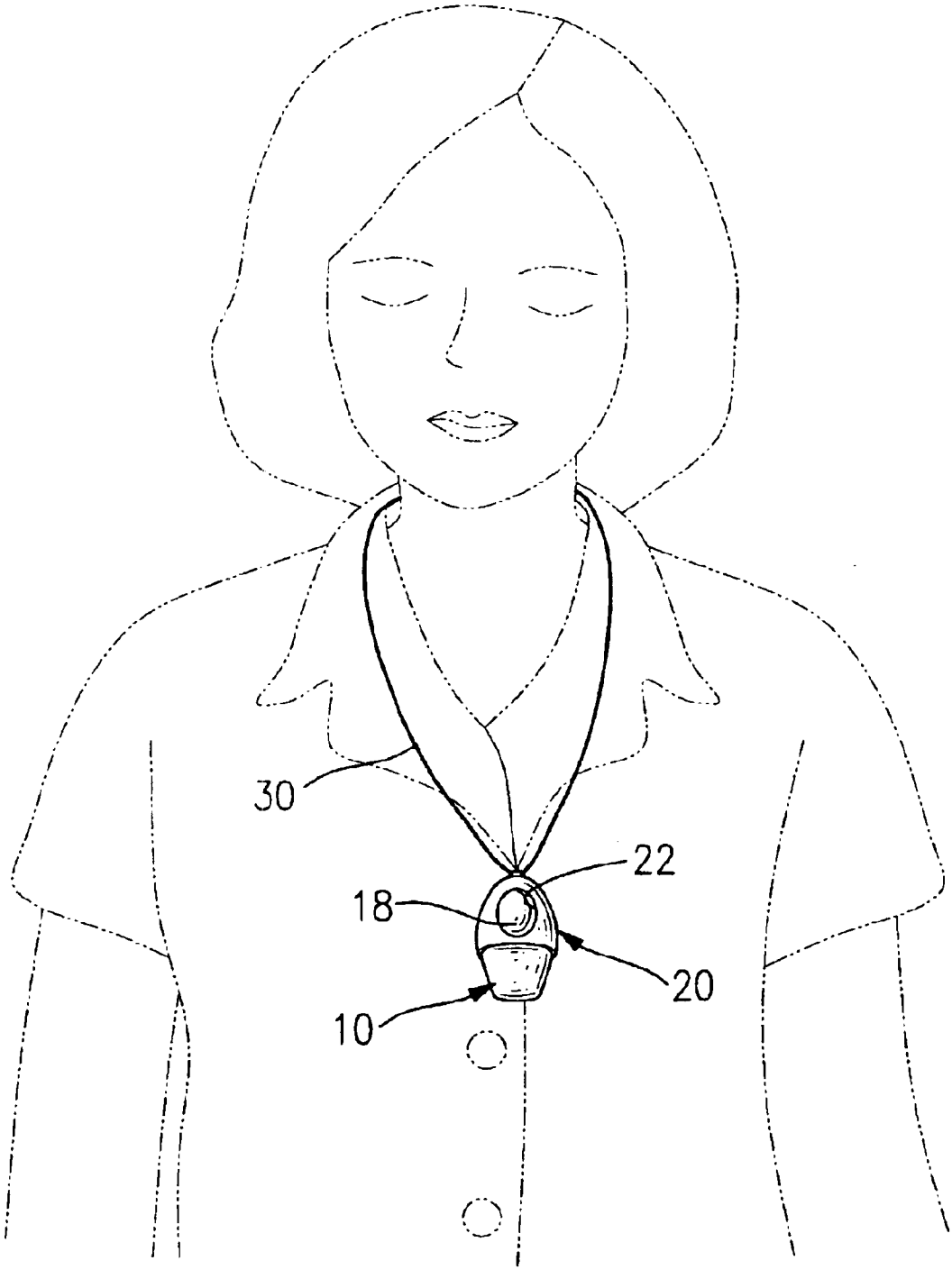
FIG. 3 is an operational top plan view of the office tool assembly in FIG. 1 hung around a person's neck with a string.

With further reference to FIG. 3, a string (30) extends through the transverse hole (24) in the hanging cap (20) so a person can hang the hanging cap (20) with the tool (10) around the neck with the string (30). In another operational embodiment, the tool assembly in accordance with this present invention can be connected to a key chain or can be hung on a belt, a bag, a knapsack or another desired object, such that the use of the office tool assembly is versatile. Accordingly, a person can conveniently and easily carry the tool (10) to any desired place and can keep his or her hands free.

When the person wants to use the tool (10), the person pushes the protrusion (18) downward through the through hole (22) in the hanging cap (20) to release the protrusion (18) from the through hole (22). Consequently, the tool (10) can be removed from the open end of the hanging cap (20), and the tool (10) can be used. When the tool (10) is no longer being used, the tool (10) is inserted into and held in the hanging cap (20). With the tool (10) in the hanging cap (20), the user will not be injured by the tool (10). The safety of using and carrying the office tool assembly is improved.

When the tool (10) is being inserted into the hanging cap (20), the protrusion is urged by a lip of the cap (20) downward into the recess (122) and the spring (19) is compressed such that the tool (10) can enter the open end of the cap (20) until the protrusion (18) aligns with the through hole (22) whereafter the resilience of the spring (19) urges the protrusion (18) into the through hole (22), whereby the tool (10) is secured in the cap (20). This design in accordance with present invention is not only applied to a tool assembly with a tool composed of two covers pivotally combined with each other, but also can be applied to a tool composed of two covers securely combined with each other. Therefore, use of the tool assembly in accordance with the present invention is versatile.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An office tool assembly for removable attachment to a user, comprising:

a hanging cap with a top, an open end and a closed end and having a through hole defined in the top of the hanging cap and a transverse hole defined through the closed end for connecting with an attachment means to selectively hang the tool assembly onto the user or an object; and a tool selectively receivable in the open end of the hanging cap and held in the hanging cap, the tool comprising:

an upper cover with a top and having a protrusion moveably mounted on the top of the upper cover and engaging the through hole in the hanging cap;

a bottom cover connected to the upper cover; and a main mechanism mounted between the upper cover and the bottom cover.

2. The office tool as claimed in claim 1, wherein the main mechanism is a sharpening mechanism.

3. The office tool as claimed in claim 1 further comprising a biasing member mounted between the upper cover and the protrusion to support the protrusion moveable on the upper cover.

4. The office tool as claimed in claim 3, wherein the upper cover has a recess with a bottom defined in the top of the upper cover;

the protrusion is moveably received in the recess and has a bottom; and the biasing member is received in the recess and has two ends abutting respectively against the bottoms of the recess and the protrusion.

5. The office tool as claimed in claim 4, wherein the protrusion has two hooks extending from the bottom of the protrusion; and the upper cover has two holes defined in the bottom of the recess and engaging respectively with the hooks on the protrusion.

* * * * *